United States Patent [19]

Cristy

[11] 4,404,768

[45] Sep. 20, 1983

[54] ARRANGEMENT FOR RELEASING A FIRE CURTAIN IN A THEATER

[76] Inventor: Nicholas G. Cristy, 31 Brighton Park, Rochester, N.Y. 14620

[21] Appl. No.: 266,296

[22] Filed: May 22, 1981

[51] Int. Cl.[3] ..... E05F 15/20

[52] U.S. Cl. ..... 49/5; 160/8

[58] Field of Search ..... 160/1, 5-9; 49/1-8; 272/22

[56] References Cited

U.S. PATENT DOCUMENTS

| | | | |
|---|---|---|---|
| 784,835 | 3/1905 | Clancy | 49/5 |
| 1,955,826 | 4/1934 | Paul | 160/7 |
| 2,819,628 | 1/1958 | Wardlaw | 160/188 X |
| 3,613,765 | 10/1971 | Sivin | 160/1 |
| 3,685,567 | 8/1972 | Pemberton et al. | 160/8 |

*Primary Examiner*—Peter M. Caun
*Assistant Examiner*—Cherney S. Lieberman
*Attorney, Agent, or Firm*—Frank J. Thompson

[57] ABSTRACT

An improved arrangement for releasing a theatrical fire curtain is described having a mechanical coupling including a gear means which is automatically disengaged upon the occurrence of combustion to enable a fire curtain to descend and cover a proscenium opening.

12 Claims, 6 Drawing Figures

10
12
14
16
17
18
20
22
24
26
28
30
32
34
36
38
40
44
46
47
48
68
70
102
110
118
124
126
128
130
132
134
136

Fig. 3
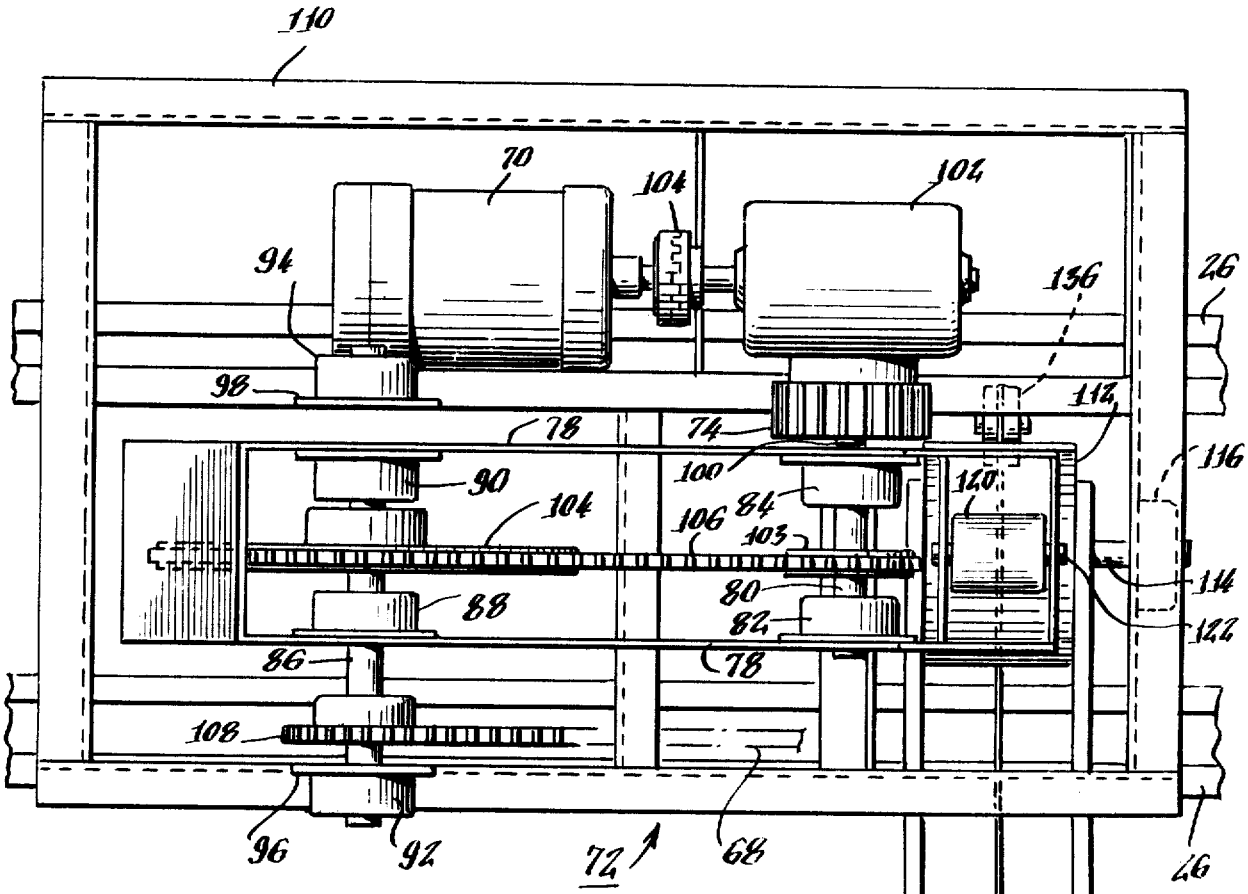
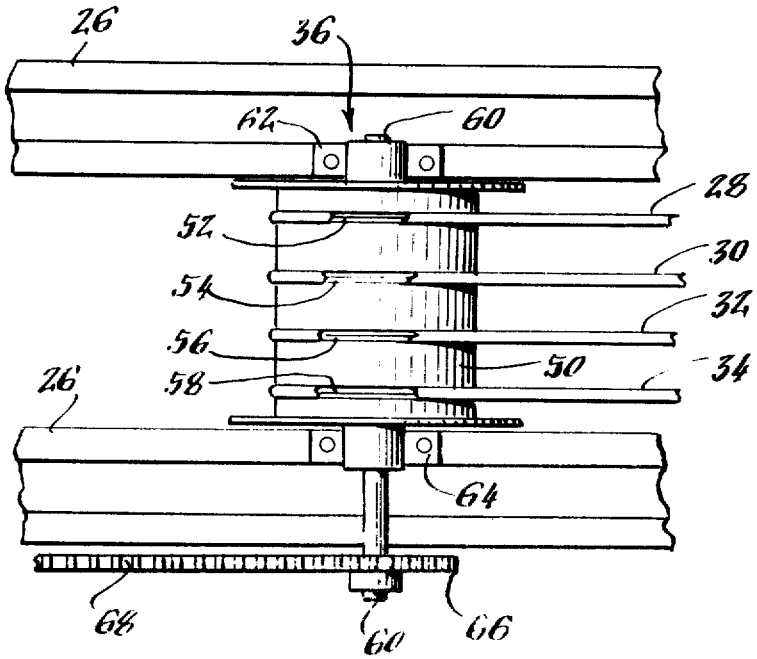
Fig. 6.

ARRANGEMENT FOR RELEASING A FIRE CURTAIN IN A THEATER

BACKGROUND OF THE INVENTION

1. Field of the Invention

This invention relates to theatrical safety curtain devices. The invention relates more particularly to an improved apparatus for automatically lowering a fire curtain in a theater.

2. Description of the Prior Art

Fire safety devices which are utilized in theaters include a fire curtain which is arranged to establish a fire resistant barrier between a backstage of the theater and the audience section. The fire curtain arrangement generally includes a curtain frame and fire resistant fabric, such as asbestos, which is suspended aloft above a proscenium opening, and, a means for automatically lowering the fire curtain to close the proscenium opening upon detection of combustion. A fire curtain is of considerable weight and in order to facilitate raising and lowering of the curtain for installation and maintenance, a counterbalance arrangement is provided. In general, the curtain is suspended from a plurality of wire ropes each of which extends vertically from the curtain to a block mounted aloft, to a rotatable traction head block, and to a counterbalance weight which is coupled to an opposite end of the wire rope. The weight of the counterbalance is selected to be somewhat less than the weight of the safety curtain. In this mechanically unbalanced arrangement, the curtain would descend. However, engagement between the wire ropes and the traction head block establishes a frictional force which resists slippage between the wire rope and head block and inhibits descent of the curtain. Rotation of the head block is inhibited by virtue of resistive frictional forces which are applied to the head block from an electric drive and speed reducing means through a mechanical coupling. Upon energization of the electric drive means, the head block is rotated in the desired direction to case the desired ascent or descent of the curtain during installation and maintenance procedures.

The safety curtain is normally suspended aloft and in order that it may automatically and rapidly descend upon the occurrence of combustion, a sensing system consisting of a cut wire having a number of fusible links formed in the wire is provided and is positioned about the proscenium opening. The cut wire extends to the mechanical coupling of the traction head block and the electric drive and speed reducing means. Upon occurrence of combustion, a fusible link will melt thereby severing the cut wire to initiate interruption of mechanical coupling between the electric drive and the traction head block. This removes the restraining force on the head block and permits the curtain to descend.

Prior safety curtain arrangements have utilized a coupling between the electric drive and the head block which includes a clutch. The clutch arrangement however has required application of a relatively large actuating force to the clutch for interrupting mechanical coupling and enabling curtain descent. A counterbalance arrangement has been provided for aiding in actuation of the clutch decoupling. However, the relatively large clutch actuating force thus provided needs to be carefully balanced to assure both freedom from premature decoupling while maintaining sensitivity to combustion. It has been observed that the required release force for actuating the clutch, because of the construction of the clutch, at times exhibits a disadvantageous tendency to vary in magnitude and can exceed the force designed to be applied thereto by the relatively sensitive balanced cut wire arrangement. This is particularly true when frequent checking and maintenance of the curtain system is not practiced and the reliability of the system is decreased. Alternatively, theater personnel must regularly and frequently operate the safety curtain apparatus in order to verify its reliability.

SUMMARY OF THE INVENTION

Accordingly, it is an object of this invention to provide an improved release apparatus for a safety curtain in a theater.

Another object of the invention is to provide a relatively economical theater safety curtain release apparatus.

Another object of the invention is to provide a theater safety curtain apparatus of improved reliability.

A further object of the invention is to provide a safety curtain release apparatus having enhanced sensitivity to changes in environmental conditions.

In accordance with features of this invention, an improved fire safety curtain apparatus for closing a proscenium opening in a theater comprises a fire curtain, a counterweight means, and a curtain support means. The support means includes elongated support members which couple the curtain to the counterweight means for supporting the curtain above a stage level of the theater adjacent the proscenium opening. A traction means is provided which engages the elongated curtain support members and alternatively, causes movement of the curtain support members when a drive force is coupled to it; it restrains movement of the curtain support members when a restraining force is coupled to it; and, it enables unrestrained motion of the curtain support members when neither drive nor restraining forces are coupled to it. A mechanical coupling means couples an electrically energized drive means to the traction means and imparts motion to the traction means when the electric drive means is energized, and, alternatively restrains motion of the traction means when the electric drive means is de-energized. The mechanical coupling means includes a gear means and a gear support means for engaging and disengaging the gear means. Upon engagement, a mechanical coupling is established between the electric drive means and the traction means to alternatively actuate or restrain the traction means. Upon decoupling of the gear means, the mechanical coupling between the electric drive means and the traction means is interrupted thereby enabling unrestrained motion of the curtain support members. A combustion-sensitive bias means is provided for causing engagement of the gear means during relatively low ambient temperatures and for enabling disengagement of the gear means upon occurrence of relatively higher temperatures.

When the ambient temperature is elevated to an unsafe level indicating the existance of combustion, the combustion sensitive bias means automatically initiates disengagement of the mechanical coupling. The traction means then enables the curtain to descend to stage level for closing the proscenium opening.

In a preferred embodiment of the invention, the traction means comprises a head block and the elongated curtain support members comprise wire ropes positioned in frictional engagement with the head block.

The gear means comprise first and second gears, one of which is mounted to a cam actuated support body. At a first position of the body, the first and second gears are maintained in engagement while at a second position of the body, the gears disengage. The combustion-sensitive bias means comprises a wire having fusible links which is coupled to the cam member for maintaining the gears in engagement, and, for enabling movement of the body to the second position upon severance of the wire to initiate disengagement, rotation of the head block, and descent of the curtain.

BRIEF DESCRIPTION OF THE DRAWINGS

These and other objects and features of the invention will become apparent with reference to the following specification and to the drawings wherein:

FIG. 3 is a plan view of the apparatus of FIG. 2;

DETAILED SPECIFICATIONS

Figure 1:
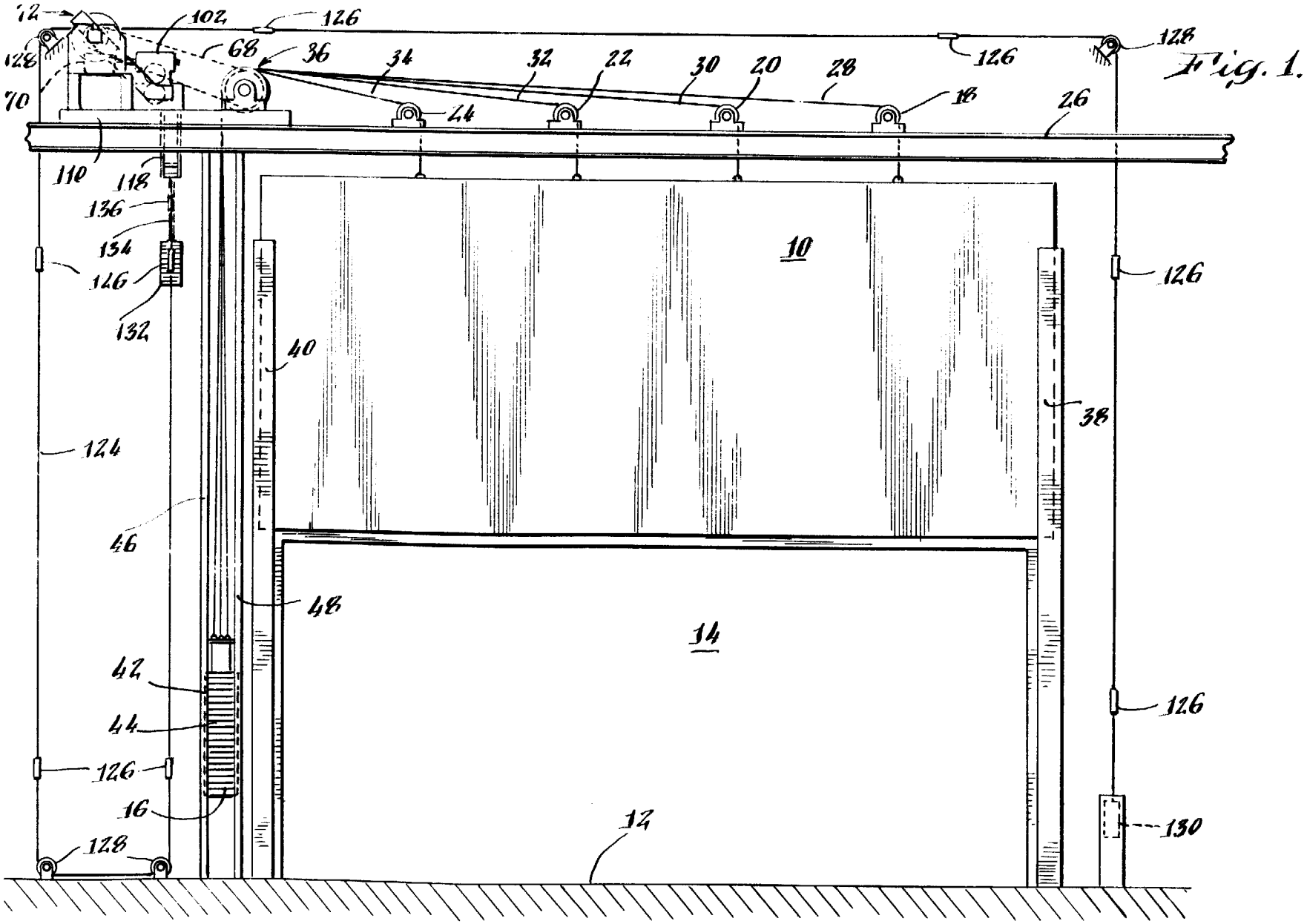
FIG. 1 is a view of a theater rear stage illustrating a safety curtain release arrangement constructed in accordance with an embodiment of this invention.

Referring now to the drawings and particularly to the rear stage view of FIG. 1, a fire curtain 10 is shown positioned aloft above a stage level 12 and adjacent to a proscenium opening 14. The weight of the curtain 10, which is fabricated of a heat and fire resistant material, such as asbestos, is substantial and a counterweight means 16 is provided for counterbalancing the weight of the curtain and facilitating its movement. The curtain 10 is supported by a means which includes a plurality of pulley blocks 18–24 which are mounted aloft on a structural member 26. The curtain support means further includes a plurality of elongated curtain support members shown to comprise a plurality of wire ropes 28–34 which are coupled between the curtain 10 and the counterweight means 16. Each of the wire ropes 28–34 is associated with one of the pulley blocks 18–24. Each of the wire ropes 28–34 frictionally engages a traction drive means comprising a head block 36 which is described hereinafter. Alternatively, the curtain support members may comprise chain and the head block include cogs for engaging the chain. The magnitude of the weight of the counterweight means 16 is selected to be slightly less than the weight of the curtain 10. However, frictional engagement between a rotary drum of the head block 36 and the wire ropes 18–34 is substantial and when the drum is restrained, the head block inhibits motion of the wire ropes 18–34 and the system is maintained in mechanical equilibrium. When the head block drum is free to rotate, the weight of the curtain 10 will cause its rotation and descent of the curtain 10 to the stage level 12 at which location it closes the proscenium opening 14. Horizontal motion of the curtain 10 during its vertical ascent and descent is limited by the vertically extending guide bars 38 and 40. The counterweight means 16 comprises a carrier 42 which is adapted to receive a plurality of individual counterweight members 44 for adjusting the weight of counterweight means 16 in accordance with the frictional forces provided by the head block 36 and the weight of the curtain 10. Vertical guide bars 46 and 48 are also provided for restraining horizontal motion of the counterweight carrier 42 during its ascent and descent.

The head block 36, best seen in FIG. 6, comprises a rotary mounted drum 50 having a plurality of circular, V grooved tracks 52–58 each of which engages one of the wire ropes 28–34 over a portion of the circumference of the groove for effecting motion of the wire rope to raise or lower the curtain 10. Alternatively, the head block may comprise a plurality of pulleys concentrically mounted and ganged together for simultaneous motion. The drum 50 is mounted to a shaft 60 and is rotably supported in pillow blocks 62 and 64. A drive sprocket 66 is mounted on the shaft. A chain 68 is coupled between the sprocket 66 and a drive, described hereinafter.

In addition to the traction head block 36, an idle head block (not shown) may be provided and mounted on the structural member 26 at an opposite end of the stage 12. The idler head block is utilized in conjunction with a second counterweight means (not shown) for uniformly distributing the weight of the curtain and the counterweights about the stage. These elements are not illustrated for purposes of simplifying the drawings. Other conventional elements such as spring buffers for intercepting the weights as they descend are similarly not illustrated.

Since the traction block 36 is rotatably mounted, it is free to rotate when unrestrained. As indicated in greater detail hereinafter, the traction block 36 is mechanically coupled to an electric drive means. When the drive means is energized, the traction block 36 will be rotated in a clockwise or counterclockwise direction to impart motion to the wire ropes 28–34 and alternatively raise or lower the curtain 10. When the drive means is deenergized and remains coupled to the traction block, frictional forces provided by the deenergized drive means and the mechanical coupling inhibit rotation of the traction block 36. However, when the traction block is mechanically decoupled from the drive means, the frictional restraining forces are removed from the wire ropes; the system is no longer in mechanical equilibrium and the weight of the curtain 10, which exceeds that of the counterweight means 16, will cause the curtain to descend to the stage level 12.

An electric drive means comprising a motor 70 (FIG. 3) is provided and is coupled to the traction block 36 by a mechanical coupling means represented generally by reference numeral 72. Mechanical coupling means 72 includes a gear means comprising first and second gears 74 and 76 and a gear support means. The gear support means includes a moveable frame-shaped, support body 78 upon which the second gear 76 is mounted for rotation. Gear 76 is mounted to a first drive shaft 80 which is supported on the moveable frame body 78 by a bearing means comprising bearing members 82 and 84. The body 78 is supported for rotation on a second drive shaft 86 by bearing means comprising bearing members 88 and 90 which are mounted to the body. The drive shaft 86 is also supported by a stationary support means comprising bearing members 92 and 94 which are mounted to upstanding bearing support frames 96 and 98 respectively. Support body 78 is pivotally rotatable about the second drive shaft 86 by virtue of the mounting of bearings 88 and 90 to the body. The gear 74 is mounted on an output shaft 100 of a speed reducer 102. Speed reducer 102 is coupled to the electric motor 70 by a flexible coupling means 104. The support body 78 is rotatable between a first position, illustrated in FIG. 4, at which position the gears 76 and 74 are engaged, and, a second position, illustrated in FIG. 5, at which position the gears 74 and 76 are disengaged.

The mechanical coupling means 72 further includes a sprocket 103 mounted to the first drive shaft 80 for rotation therewith, a sprocket 104 mounted to the second drive shaft 86 for rotation therewith, and a coupling means comprising a chain 106 coupled to the sprockets 103 and 104 for coupling rotary motion from the gear 76 via the shaft 80 to the drive shaft 86. A sprocket 108 is mounted to the drive shaft 86 for rotation therewith and this sprocket is coupled via the chain 68 to the sprocket 66 (FIG. 6) which is mounted to the shaft 60 of the traction block 36. The coupling means 72 (FIG. 3) along with the drive motor 70 are supported aloft by a rectangular assembly 110 of welded members which is supported by the structural member 26. Energization of the motor 70 causes rotation of the traction block to alternatively raise or lower the curtain. Prior to disengagement of the gears 74 and 76, the traction block 35 is restrained by the frictional forces of the drive train which couple the motor 70 to the traction block 36. A substantial part of the frictional forces for restraining rotary motion of the traction block 36 is provided by the speed reducer 102.

Figure 2:
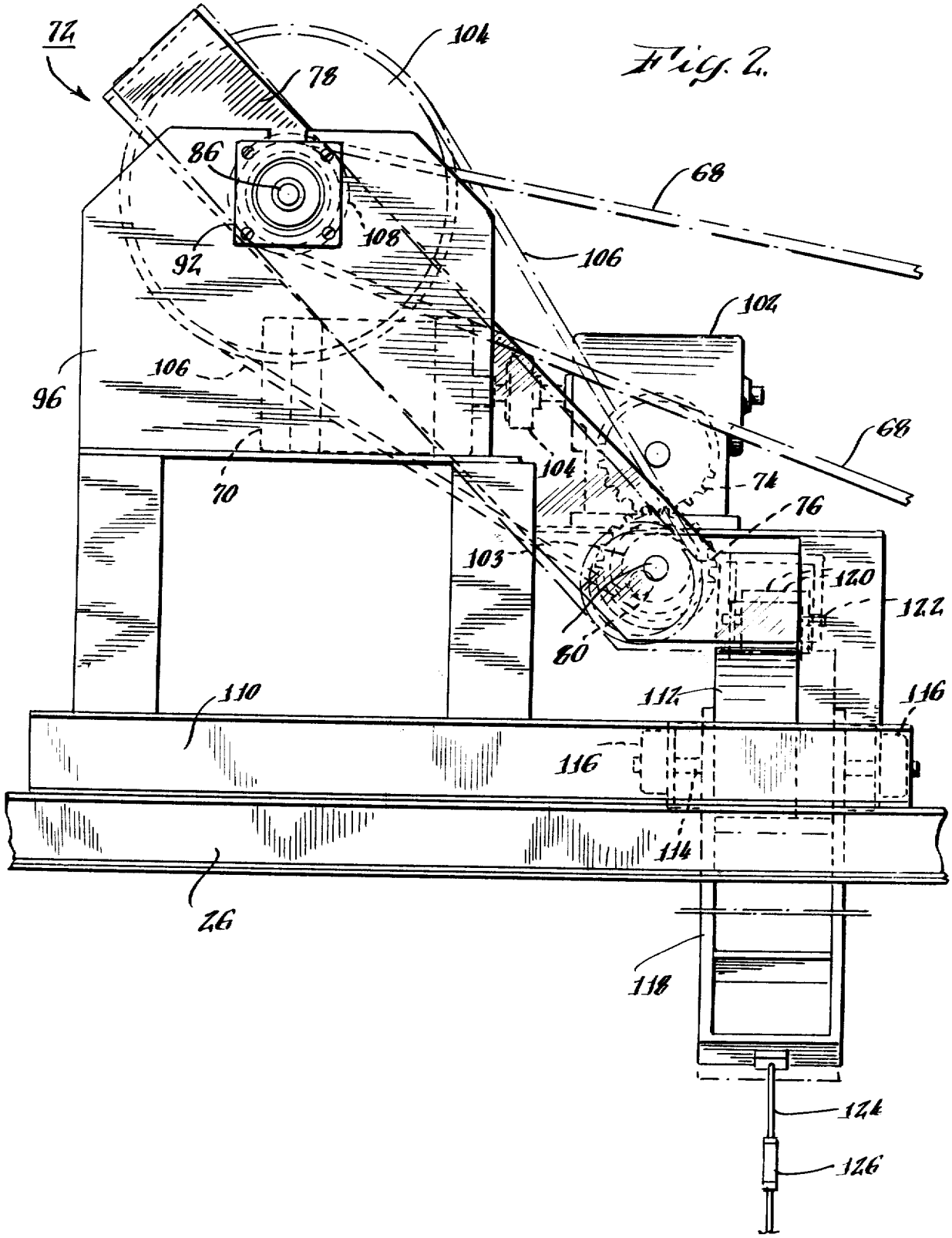
FIG. 2 is a fragmentary, enlarged, side elevation view of a release apparatus used with the arrangement of FIG. 1.
Figure 4:
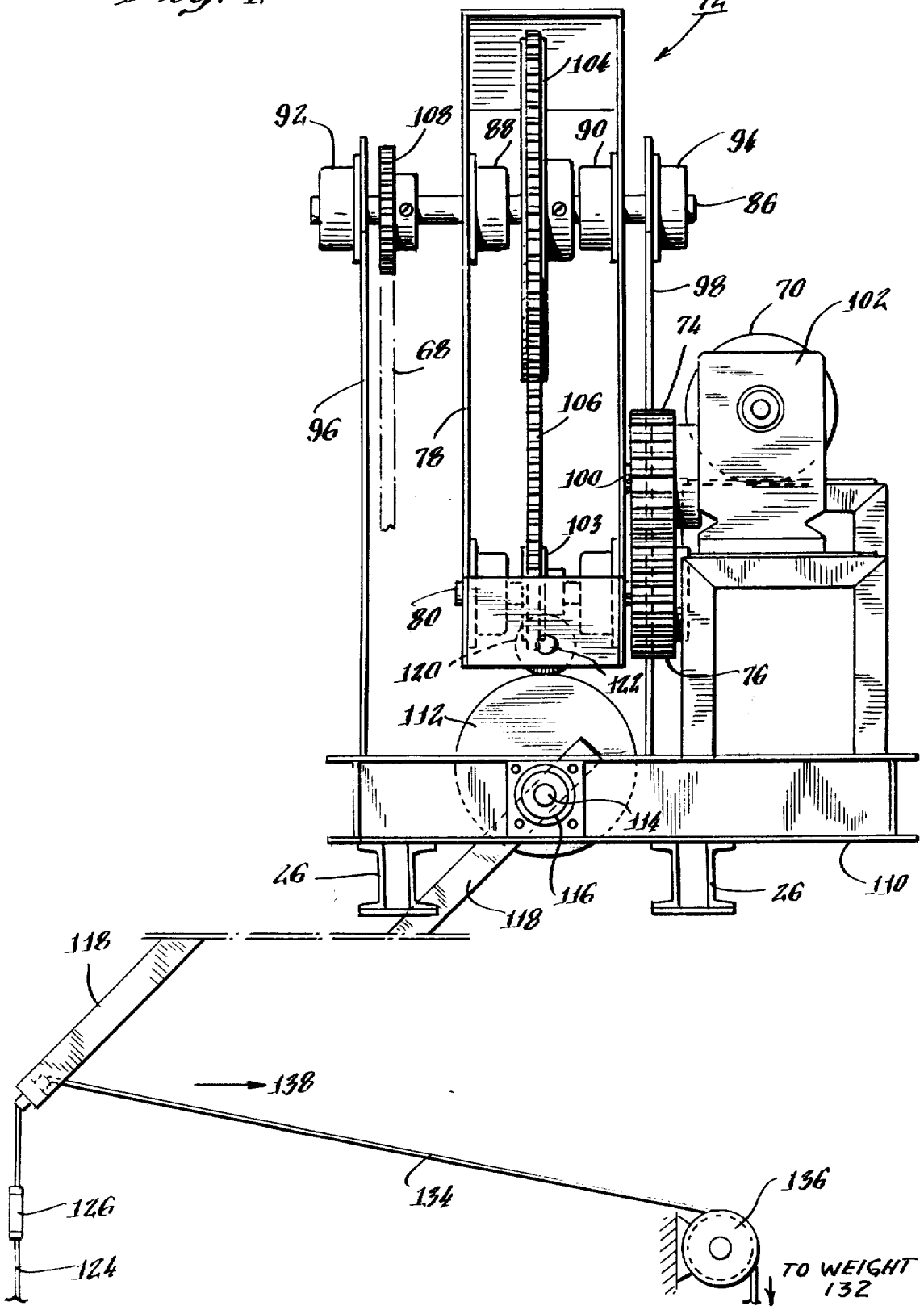
FIG. 4 is an end view of the apparatus of FIG. 2 illustrating a drive coupling in engagement.
Figure 5:
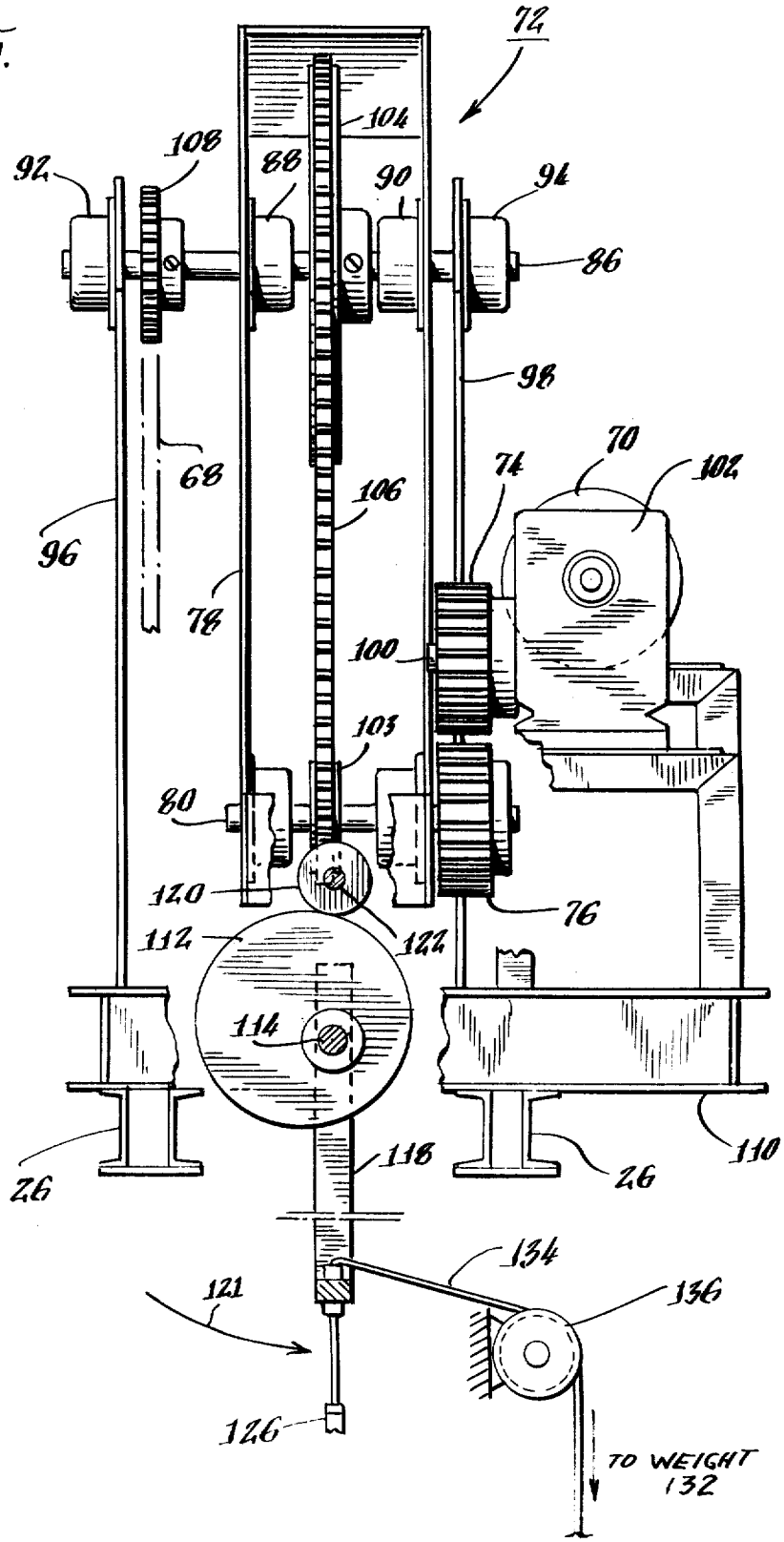
FIG. 5 is another view of the apparatus of FIG. 4 illustrating disengagement of a drive coupling; and, FIG. 6 is an enlarged, fragmentary, plan view, partly in section of a traction block used with the arrangement of FIG. 1.

A positioning means including a heat sensitive member is provided for positioning the support body 78 at the first position (FIG. 4) at a relatively low ambient temperature and for positioning the support body 78 at the second position (FIG. 5) at a relatively higher ambient temperature. The positioning means includes a generally cylinder shaped cam body 112 which is eccentrically mounted by a shaft 114 and a rotary support bearing 116 on the assembly 110. An actuating arm 118 is mounted to the cam 112. A cam follower 120 is rotatably mounted on a shaft 122 which is mounted to the support body 78. Rotation of the arm 118 to an orientation as illustrated in FIG. 4 rotates the periphery of the cam 112 to its highest elevation and in this position, the cam follower 120 causes the frame member 78 to rotate about the shaft 86 in a counterclockwise direction as viewed in FIG. 2 and to advance the gear 76 into engagement with the gear 74. In this position, mechanical coupling is established between the drive motor 70 and the traction block 36. As the arm 118 rotates in a counterclockwise direction as viewed in FIGS. 2 and 4 and represented by arrow 121 to the second position as illustrated in FIG. 5, the cam 112 rotates, and because of its eccentric mounting, the periphery of the cam descends to a lower elevation. The cam follower 120 follows the descending cam periphery and permits the movable frame shaped body 78 to rotate about the shaft 86 and to descend a distance for disengaging the gears 74 and 76. In this position, mechanical coupling between the drive motor 70 and the traction block 36 is interrupted, rotation of the traction block is enabled and the curtain 10 descends as indicated hereinbefore.

The positioning means further includes a first bias means which is coupled to the cam actuating arm 118 for biasing the support body 78 to the first position of gear engagement. The first bias means includes an elongated wire 124 positioned about the proscenium opening (FIG. 1) and having a plurality of fusible links 126, a plurality of pulley wheels 128 for supporting the wire and a biasing weight 130. Wire 124 is arranged and coupled to the actuating arm 118 in a direction for biasing the body 78 to the first position of gear engagement as illustrated in FIG. 4. The fusible links 126 sever at a predetermined relatively high ambient temperature indicative of combustion and fire. Other forms of combustion detectors can be employed. The bias provided by the weight 130 and the wire 124 maintains the body 78 at the first position and this maintains engagement between the electric drive means 70 and the traction block 36. When the ambient temperature elevates to a level indicative of the presence of combustion and fire, ambient heat will cause a fusible length 126 to sever and remove the bias weight 130 from the actuating arm 118. The arm 118 will rotate with cam 112 to initiate disengagement of the gears 74 and 76. A means for biasing the actuating arm 118 to the second position of the body 78 as indicated in FIG. 5 is provided by the combined weight of the body 78 and the elements and members mounted thereon, and, a weighted body 132 (FIG. 1). Weight 132 is coupled to the actuating arm 118 by a wire segment 134 (FIG. 4) and a pulley 136 for applying a force to the arm 118 in the direction indicated by the arrow 138 of FIG. 4. This force causes rotation of the lever arm in a counterclockwise direction as viewed in FIG. 4 to the second position thereby moving the support body 78 to its second position (FIG. 5) and disengaging the gear 74 and 76. A restraining force is thereby removed from the traction block 36, the block is enabled to rotate, and the curtain 10 descends to close the proscenium opening.

There has thus been described an improved safety curtain arrangement and release apparatus for enabling the automatic descent of a fire curtain for closing a proscenium opening in a theater upon the occurrence of combustion and fire. The arrangement and apparatus are advantageous in that they are substantially reliable, sensitive to ambient conditions and economical.

While there has been described a preferred embodiment of the invention, it will be apparent to those skilled in the art that variations may be made thereto without departing from the spirit of the invention and the scope of the appended claims.

What is claimed is:

1. An improved fire safety curtain arrangement for closing a proscenium opening in a theatre comprising:

a. a fire safety curtain having a weight thereof;

b. a counterweight means for counterbalancing a part of said curtain weight;

c. a curtain support means for supporting said curtain above a stage level of the theatre adjacent a proscenium opening, said curtain support means including elongated support members coupling said curtain to said counterweight means;

d. a traction means engaging said elongated support members for alternatively causing movement of said elongated support members when a drive force is coupled to said traction means, for restraining movement of said elongated support members when a restraining force is coupled to said traction means, and for enabling unrestrained motion of said elongated support members upon decoupling of drive and restraining forces from said traction means;

e. an electrically energized drive means;

f. means for mechanically coupling said drive means to said traction means for imparting motion to said traction means when said drive means is energized and alternatively for restraining motion of said traction means when said drive means is deenergized;

g. said mechanical coupling means including first and second gears, means rotatably mounting said first gear at a stationary location, a moveable support body, means for rotatably mounting said second gear to said moveable support body for movement therewith, means for rotatably mounting and positioning said support body for providing engagement of said first and second gears at a first rotational position of said support body and for providing disengagement of said gears at a second rotational position of said support body;

h. a positioning means for positioning said support body at said first engaged position at a relatively low ambient temperature and for positioning said support body at said second disengaged position at a relatively high ambient temperature;

i. said positioning means including a cam follower mounted to said support body, a cam body mounted to a stationary body and positioned for engaging said cam follower for causing said moveable support body to rotate between said first and second positions, said cam body and cam follower maintained in engagement by a weight force of said support body and coupling members mounted thereto, an elongated actuating member coupled to said cam body, a first bias means including a combustion sensitive member coupled to said actuating member for biasing said support body to said first position, said combustion sensitive member adapted to sever at a predetermined temperature, and means coupled to said actuating member for rotating said support body to said second position when said combustive member severs.

2. The arrangement of claim 1 wherein said first bias means includes a line having a plurality of fusible links, each of said fusible links is severable at a predetermined ambient temperature, and means coupled to said line for establishing a bias force on said cam body actuating member.

3. The arrangement of claim 1 wherein said means for rotating said actuating member includes a weight and means for coupling the weight to said member for applying a force to said actuating member.

4. The arrangement of claim 1 wherein said means for mounting said second gear to said support body includes a first drive shaft, said second gear is mounted to said first drive shaft for imparting rotary motion thereto, said mechanical coupling means includes a second drive shaft, means for mechanically coupling rotary motion from said first drive shaft to said second drive shaft, and means for coupling rotary motion from said second drive shaft to said traction means.

5. The arrangement of claim 4 wherein said support body comprises a frame shaped body having means mounted to said frame body for movement therewith for rotatably supporting said first and second drive shafts on said frame body.

6. The arrangement of claim 5 wherein said means for rotatably mounting said frame shaped support body includes stationary bearing means positioned for rotably supporting said second drive shaft for enabling pivoting rotation of said frame body about said second drive shaft.

7. The arrangement of claim 4 wherein said drive means comprises an electric motor and said mechanical coupling means includes a speed reducing means coupled between said electrical motor and said first gear.

8. The apparatus of claim 4 wherein said elongated curtain support members comprise a plurality of wire ropes, and said traction means comprises a head block having a plurality of grooves formed therein for providing frictional engagement with said wire ropes.

9. The apparatus of claim 5 including first and second sprocket means coupled to said first and second drive shafts respectively, a drive chain intercoupling said first and second sprocket means, a third sprocket means mounted to said second drive shaft, a fourth sprocket means mounted to said traction means, and a means mechanically intercoupling said third and fourth sprocket means.

10. The apparatus of claim 5 wherein said cam follower is mounted to said frame body at an elevation which is relatively higher than said cam body.

11. An improved safety curtain release apparatus for coupling a drive to a traction means to raise and to alternatively lower a theatre fire curtain, and, for automatically decoupling the drive upon occurrence of ambient conditions indicative of combustion to enable descent of the curtain, comprising:

a. an electrically energized drive means;

b. means for mechanically coupling said drive means to a fire curtain traction means for imparting rotary motion to the traction means to raise and lower the curtain when said drive means is energized and alternatively for restraining motion of said traction means when said drive means is deenergized;

c. said mechanical coupling means having a drive coupling gear means and a gear support means for alternatively engaging and disengaging said gear means to thereby respectively establish and interrupt mechanical coupling between said drive means and said traction means;

d. said gear support means comprising a rotatably mounted support body having a weight thereof, said gear means including a first gear mechanically coupled to said electric drive means and a second gear mounted to said support body for rotation therewith into and out of engagement with said first gear upon rotation of said support body, e. a combustion sensitive means for positioning said support body to establish engagement of said gear means and for enabling disengagement of said gear means upon occurence of a relatively high ambient temperature indicative of combustion;

f. said positioning means including a cam follower mounted to said support body, a cam mounted to a stationary body and positioned in engagement with said cam follower for imparting motion to said support body between a first rotational position at which said gears are engaged and a second rotational position at which said gears are disengaged, said cam and cam follower maintained in engagement by the weight of said support body and members mounted thereto, an actuating arm coupled to said cam, combustion detection means coupled to said actuating arm for biasing said cam at said first position, and means for causing movement of said cam to said second position upon detection of combustion.

12. The apparatus of claim 11 wherein said combustion detection means comprises a wire having a plurality of fusible links.

* * * * *